US005295537A

United States Patent [19]

Trainer

[11] Patent Number: 5,295,537

[45] Date of Patent: Mar. 22, 1994

[54] SAND SEPARATING, PRODUCING-WELL ACCESSORY

[76] Inventor: C. W. Trainer, 8090 E. Kalil Dr., Scottsdale, Ariz. 85260

[21] Appl. No.: 924,836

[22] Filed: Aug. 4, 1992

[51] Int. Cl.[5] ..... E21B 43/00

[52] U.S. Cl. ..... 166/105.1; 166/105.3

[58] Field of Search ..... 166/105.1, 105.3, 227, 166/105.2

[56] References Cited

U.S. PATENT DOCUMENTS 2,429,043 10/1947 Barnhart ..... 166/105.1 X
3,106,526 10/1963 Schmidt ..... 166/105.1 X
3,289,608 12/1966 Laval, Jr. ..... 166/105.1

*Primary Examiner*—William P. Neuder
*Attorney, Agent, or Firm*—James F. Duffy

[57] ABSTRACT

A sand separator is used in a well from which particulate bearing liquids are extracted into tubing for transport up the tubing. The separator causes the fluid bearing particulate matter to be accelerated. This acceleration in turn causes the particulate matter to separate from the fluid because of the higher mass and greater inertia of the particulate matter. The fluid, after separation of the particulate matter, is drawn up through the pump. The particulates preferably accumulate within a sand trap which can be pulled from the well and emptied as desired. In the case wherein the particulate matter tends to float within the liquid part of the mixture, a strainer is added after the initial inertia separation of particles from the liquid. The strainer prevents the passage of particulate matter which would tend otherwise to float upward into the output port by which the liquid passes up the tube.

18 Claims, 2 Drawing Sheets

SAND SEPARATING, PRODUCING-WELL ACCESSORY

BACKGROUND

1. Technical Field of the Invention

The invention relates to equipment for use in a fluid producing well. In particular, the invention is disclosed as apparatus for separating sand from the fluids extracted from a well. The description which follows discloses the invention in use in an oil well, having no intention, however, to so limit the use of the invention.

2. Prior Background Art

In pumping fluids from a well, for example an oil well, certain difficulties may arise depending upon the nature of the fluids being extracted. Frequently, natural gas is encountered as one of the fluids taken from an oil well. If the well is self pressurized, there is no need to separate the gasses from the liquids. However, if a pump must be employed to remove the fluids, it is desirable that the gasses be separated from the other fluidic materials before the liquids enter the pump, otherwise, gasses entering the pump may cause the pump to gas lock. The fluids will frequently also include a mixture of oil and water. These liquids can be readily separated after they are extracted from the well.

A problem does arise, however, when the liquid portions of the fluids contains particulate matter such as sand. This particulate matter, especially if sand, tends to abrade the moving surfaces into which the sand-bearing liquids come into contact. For example, pumps have a significantly shortened working lifetime when the liquids being pumped carry sand or other abrasive particulate matter.

Sand strainers are commercially available for insertion into the well casing to separate sand or other particulate matter from the liquids rising from a pressurized well or being pumped to the surface. However, the inventor herein has found no commercially available sand separator which performs to his satisfaction.

It is the objective of the present invention to provide a simple sand separating means for removing sand from liquids to be extracted from a well. It is a further objective of the invention to define embodiments of the invention which will successfully separate either water-borne sand, or oil-borne sand, or both.

SUMMARY DESCRIPTION OF THE INVENTION

The invention is a sand separator for use in separating sand and other particulates from fluids being extracted from a well. It includes tubing for raising liquids. A sand trapping casing is coupled to the tubing. Means are coupled to the sand trapping casing for extracting liquid therefrom for passage up the tubing.

The sand trapping casing includes a high velocity orifice through which liquids are drawn from the well. The liquids and any sand and particulate matter carried by the liquids are accelerated in passing through the high velocity orifice. Thus, any of the sand and particulate matter carried by the liquid is propelled into the sand trapping casing while the liquid is drawn up the tubing.

In the case in which the fluids being extracted from the well comprise both gaseous and liquid components, the sand separator further comprises an open topped, gas separation casing coupled to the sand trapping casing. The gas separation casing encompasses and rises above the high velocity orifice. The sand separator is emplaced in a well casing so that liquids are drawn to overflow into the open topped gas separation casing while the fluid gasses rise up the well casing.

The sand trapping casing includes means coupled therein for directing any sand and particulate matter exiting the high speed orifice toward the bottom of the sand trapping casing. The means for directing the sand and particulate matter comprises a conic-shaped vessel open at a first end to receive the sand and particulate matter and open at a second end to allow egress of the sand and particulate matter from the vessel.

There is also a sand strainer for restricting passage of the sand and particulate matter up the tubing. The sand strainer is coupled to the tubing to intercept liquid being pumped from the sand trapping casing. The strainer has a strainer body emplaced within the sand trapping casing. The strainer body has a first end coupled to the tubing. In a presently preferred embodiment, the strainer body has a selected length, there being a jet tube having an exit extending a selected distance beyond the selected length of the strainer body. The high velocity orifice constitutes the exit of the jet tube. The strainer body may comprise a pipe having a wall with an opening therethrough. Liquids flow from the sand trapping casing through the opening into the tubing. The opening is covered with strainer means to permit passage of liquid to the opening while restricting passage of sand and particulate matter.

There is a sand strainer for restricting passage of the sand and particulate matter up the tubing. The sand strainer is coupled to the tubing to intercept liquid passing from the sand trapping casing into the tubing. The strainer has a strainer body emplaced within the sand trapping casing and has a first end coupled to the tubing. The strainer body has a selected length. There is a jet tube which has an exit extending a selected distance beyond the selected length of the strainer body, the high velocity orifice being the exit of the jet tube.

The strainer body itself is a pipe having a wall with an opening therethrough. Through this opening liquids flow from the sand trapping casing to the tubing. The opening is covered with strainer means to permit passage of liquid to the opening while restricting passage of the sand and particulate matter.

From a different aspect, the sand separator includes a jet-tube having an input end into which liquid enters from the well. A high velocity orifice is an output end of the jet-tube through which the liquid is ejected into the sand trapping casing. An open topped strainer body encompasses the jet-tube, and has a base through which the output end of the jet-tube exits the strainer body. There is an up-orifice in the strainer body through which liquid flows into the strainer body to flow out the open top of the strainer body. Strainer means are coupled to the up-orifice to pass liquid from the sand trapping casing through the up-orifice while restricting passage of sand and particulate matter from the sand trapping casing. The open top of the strainer body, in turn, is coupled to the tubing whereby liquid entering the strainer body from the sand trapping casing passes up the tubing.

In the sand separator the means for extracting liquid from the sand trapping casing may be either a head of pressure within the well or a pump coupled to the tubing.

DETAILS OF BEST MODE FOR CARRYING OUT THE INVENTION

Figure 1:
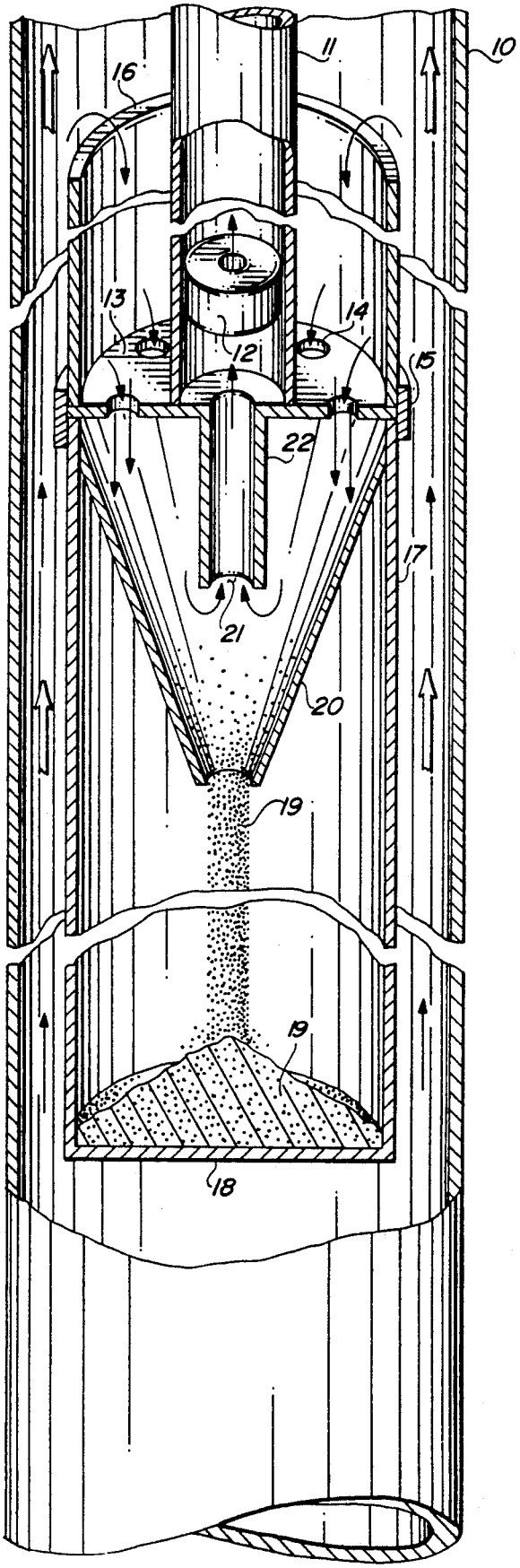
FIG. 1 is a perspective view, in cross-section, of a first embodiment of the invention showing the sand separator with a conic-shaped sand director.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

The invention is shown in the working environment of an oil well in FIG. 1. The drawing is a cross-sectional perspective view indicating the oil well casing 10 with the rods and tubing 11 which extend downward into the casing. In a well which is not self pressurized, tubing 11 carries a pump 12 which is intended to draw up liquids from the well. In the discussion which follows it will be assumed that various fluids will be evacuated from the well. These fluids will include gasses, oil, and water. The liquids, oil and water, will be assumed to carry particulate matter as well, for example, sand.

Whether the well is self pressurized and extraction of the fluidic materials proceeds without pumping, or the well has lost its pressure head, if such existed, and extraction requires the use of a pump, in either case, the invention will find utilization to remove sand and particulate matter. As a general case, for exposition purposes, it will be assumed that the well is not self pressurized and that a pump is in use.

As FIG. 1 indicates, tubing 11 is connected to flange 13 below pump 12. Flange 13 has one or more high velocity orifices 14 through which liquid and sand will be drawn by action of pump 12. The restrictive orifices 14 act to increase the velocity of the liquids and liquid borne particulate matter passing there through.

Flange 13 is coupled to and retained between casings 16 and 17 by means of a pipe collar 15. The upper pipe casing is here denoted as the gas separator casing 16. The lower casing 17 preferably has a bottom plug 18 and is here denoted as sand trap casing 17. A pipe extender 22 is affixed to flange 13 to provide access for liquids to pass via up-orifice 21 into tubing 11 under the impress of pump 12. Pipe extender 22 extends downward into the conic-shaped sand director 20. In practice, gas separator casing 16 and sand trap casing 17 may each have lengths approximating thirty feet. This length is noted as an aid to disclosure and not with any intention of limiting the invention.

In pumping fluids from oil well casing 10, gasses, indicated by the double arrows, and liquids, indicated by the single arrows, pass upwards in oil well casing 10 until they reach the top of gas separator casing 16. At this point the liquids, and any particulate matter which they may be carrying, tend to overflow into gas separator casing 16. The gasses tend to continue up oil well casing 10. The liquids, for example oil and water, along with the particulates which they may be carrying, for example sand, will be drawn through high velocity orifices 14.

A note in passing: in a self pressurized well, the well casing will be closed off at the surface and the internal pressure in the well will force gasses and liquids, as well as any sand or particulate matter carried by the fluids, through the high velocity orifices. Both gasses and liquids will pass up the tubing. The operation of the sand separation invention is as follows except for the fact that gas accompanies the liquids up the tubing.

In passing through restrictive, high velocity orifices 14, the liquids and their particulate matter are accelerated. Sand 19 will strike the inclined walls of sand director 20 and exit at its base to accumulate at the bottom of sand trap casing 17 on its plugged bottom 18. The liquids however, having less mass than the particulate materials, will display less inertia and will be drawn upwards through up-orifice 21 into pipe extender 22 to pass through pump 12 and continue on up through tubing 11.

At regular time intervals, dictated by experience, or on occasions when the draw of pump 12 is reduced, sand trap 17 may be pulled upwards from well casing 10 to empty it empty it of its accumulation of sand 19. This is new in the art.

Figure 2:
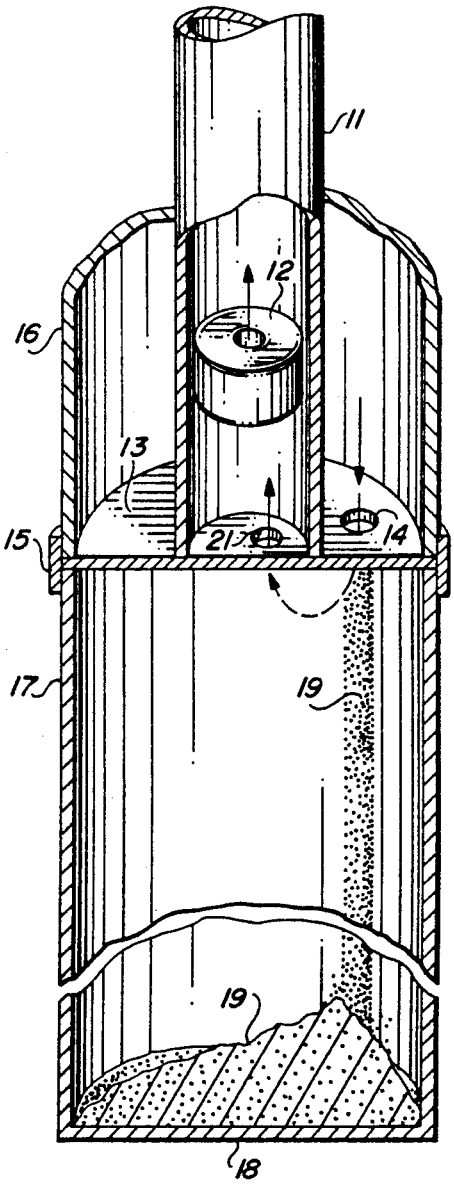
FIG. 2 is a cross-sectional perspective view of an early prototypical sand separator.

The embodiment of FIG. 1 is drawn from an earlier prototypical embodiment illustrated in FIG. 2. In this earlier embodiment there was no conic-shaped sand director 20 as shown in the embodiment of FIG. 1. Fluids and particulate matter were carried downward through high velocity orifice 14 and the sand, having been accelerated, continued on toward the bottom of sand trap casing 17 while liquids were drawn through up-orifice 21 through pump 12 and upwards into tubing 11. The later embodiment of FIG. 1 achieves greater volumetric pumping capacity while maintaining a highly efficient separation of particulate matter from the liquids.

Like-reference numbers, as used in FIGS. 1 through 4, accompany elements which perform similar functions.

Assume for a moment that the particulate matter associated with the liquids being extracted from tubing 11 had originated within the water-borne portion of the liquid-particulate mix. Sand or other particulate matter which is found within the earth within water bearing strata tend to sink downward in an oil-water mix. Thus, in a still container, this particulate matter would tend to separate from the liquids and settle to the bottom of the container. However, it has been noted that when sand or other particulate matter originates from earth strata containing oil, the resulting oil-particulate matter mixture does not readily separate, the oil impregnated sand or other particulates tending to float within the liquids, especially when the water portion of the liquid mix is brine.

In a well in which the liquid contains a great deal of oil impregnated particulate matter, the tendency for the particulate matter to float within the liquid mix may result in poor separation within conic-shaped director 20. Thus, an undesirable portion of oil impregnated sand or other particulate matter may be drawn through up-orifice 21 and through pump 12. To overcome this potential problem the embodiment of FIG. 3 was derived.

Figure 3:
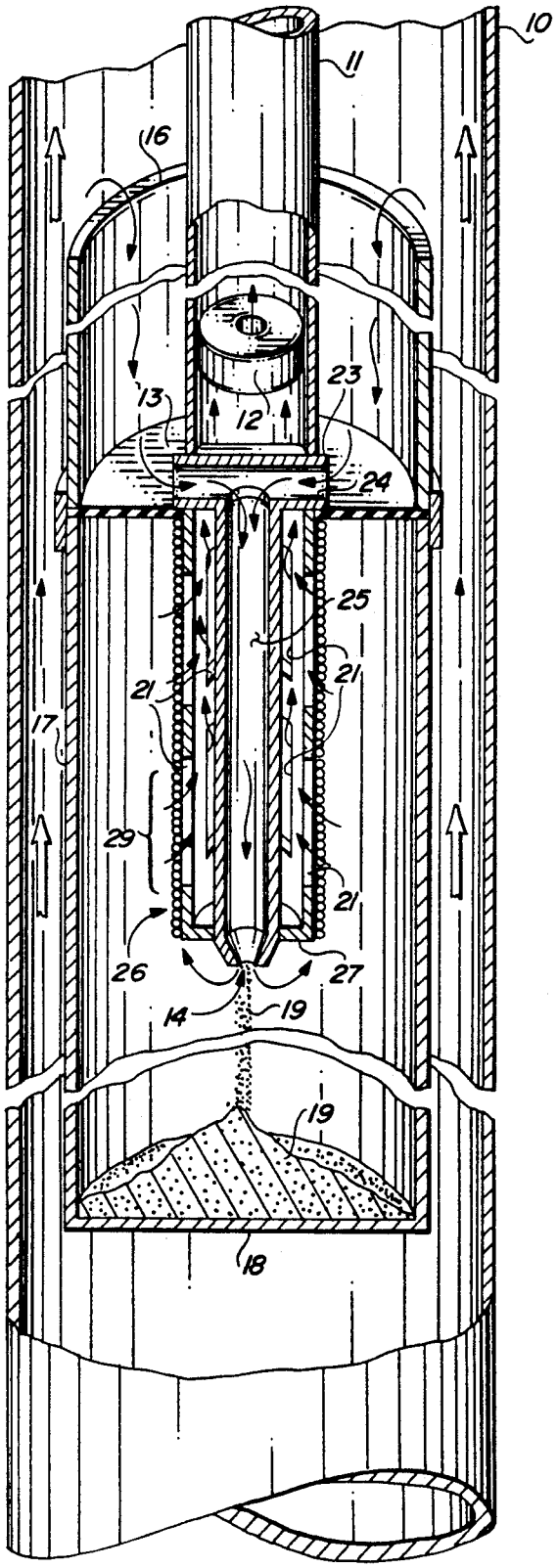
FIG. 3 shows an embodiment of the sand separator having a sand strainer. The drawing is a cross-sectional perspective view.

In the embodiment of FIG. 3, the liquid-particulate mix overflows into gas separator casing 16 to enter the input ports 24 of pipe tee 23. Pipe tee 23 is coupled to flange 13 and tubing 11 so no liquids or particulate matter may enter tubing 11 by bypassing the input port 24 of tee 23.

Liquids and sand and other particulate matter entering input ports 24 travels down jet tube 25, which is the elongate arm of tee 23. The liquid-particulate matter mixture exits from high velocity orifice 14 at the end of jet tube 25. As before, the particulate matter and the liquid are accelerated by high orifice 14 and the higher mass, particulate matter continues to travel downward to accumulate at plug 18 on the bottom of sand trap casing 17, assuming that casing 17 has been plugged, as is preferred. The liquid portions, on the other hand, are drawn upwards through up-orifices 21 in strainer body 27. Strainer body 27 is part of sand strainer 26 whose construction is indicated in somewhat greater detail in the exploded assembly drawing of FIG. 4.

Figure 4:
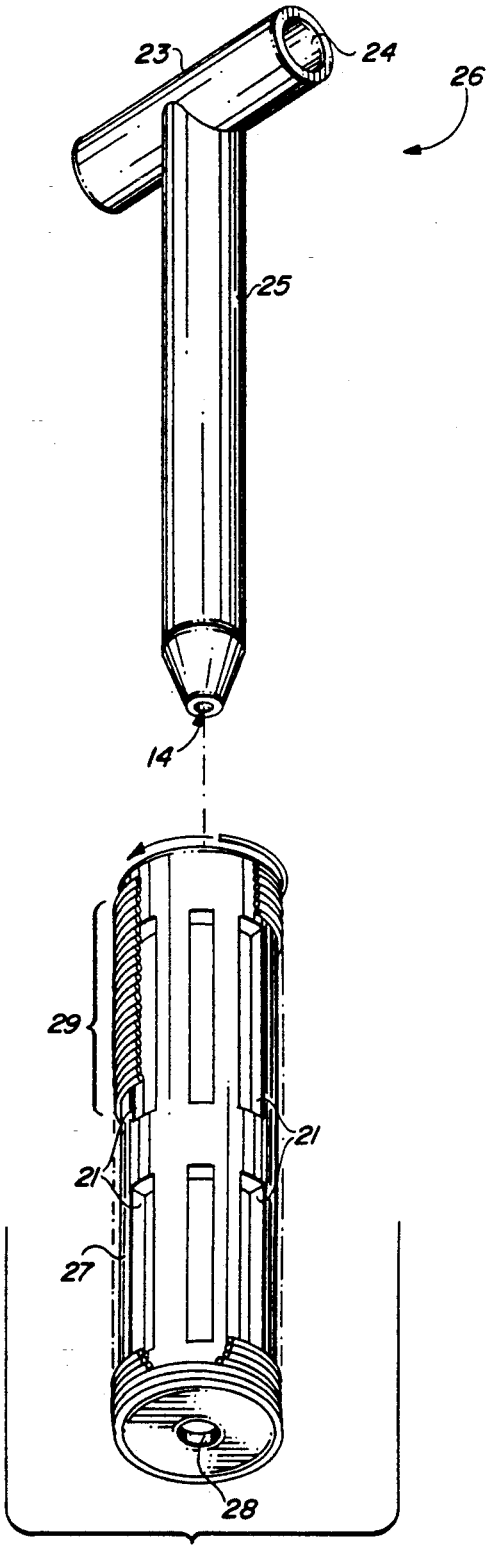
FIG. 4 is an exploded assembly drawing, in perspective, of the sand strainer of FIG. 3 with the jet tube tee removed and the wire wrapping loosened.

In FIG. 4 strainer body 27 is illustrated as a cylinder having a plurality of up-orifices 21 through which liquid may be communicated to the interior of strainer body 27. The elongated jet tube 25 of tee 23 is passed downward through strainer body 27 such that its high velocity orifice 14 exits through opening 28 at the base of strainer body 27. The upper end of body 27 is open for liquids to pass past the tee section containing input ports 24. When tee 23 is installed in strainer body 27, such that the upper portion of tee 23 is transverse to the axis of body 27, liquids still may exit from the top of body 27 around tee 23.

In order to remove sand, especially oil impregnated sand and other particulate matter which may tend to float within an oil and brine mixture, a strainer is provided by wrapping the outside of strainer body 27 with wire 29. This wrapping of body 27 with wire 29 was originally achieved in a prototype model by placing strainer body 27 in a lathe and wrapping body 27 with fence wire. The wire was wrapped in tight, intimate contact with body 27 such that each wire wrapping was also in intimate contact with its adjacent wire wrapping. The wire wrapping is indicated only partially in FIG. 4 but is shown in greater detail in the cross-sectional view of FIG. 3.

Recalling that the liquid-particulate matter mixture overflows into gas separator casing 26 to enter input ports 24 of tee 23, the mix then travels down through jet tube 25 to exit from high velocity orifice 14. The accelerated particulate matter, for example sand 19, continues to travel away from the pipe 25 and to accumulate on the top of plug 18 at the bottom of sand trap casing 17, which plug is preferably positioned there. The liquid components, however, are drawn upwards through small interstitial spacings between the wire rapping 29 placed about strainer body 27.

In passing through these fine spaces the liquid enters strainer body 27 via up-orifices 21. The liquid then flows upward about the transverse arm of tee 23 passing through pump 12 and continuing up tube 11. The spacing between wires in wire wrapping 29 is too small to allow sand and other particulate matter to enter into up-orifices 21. Thus, the passage of sand and other particulate matter is effectively blocked from passage through pump 12 and up tube 11.

In the embodiments of FIGS. 1 and 2, the modus operandi for separation of particulate matter from liquids which bear the particulates tends toward accelerating the liquid-particulate matter mix and utilizing inertia to achieve the necessary separation of the particulates from the liquids. This reliance upon inertia to achieve separation is again a feature of the embodiment of the invention shown in FIG. 3. However, the embodiment of FIG. 3 anticipates that oil impregnated particular matter may exist in the liquid-particulate matter mix. Such oil impregnated particulates may tend to float, especially if the liquid is an oil-brine mixture. Floating particulates will be eliminated by the wire wrapped strainer 26.

The embodiment of strainer 26 is presented as a presently preferred embodiment and is disclosed for expository purposes with no intention of limiting the invention to that particular physical embodiment of a strainer.

What has been disclosed is a sand separator for a well in which particulate bearing liquids are extracted from the well into tubing for transport up the tubing. The separator causes the fluids bearing the particulate matter to be accelerated. This acceleration in turn causes the particulate matter to separate from the fluid because of the higher mass and greater inertia of the particulate matter. The fluid, after separation of the particulate matter, is drawn up through the pump. The particulates preferably accumulate within a sand trap which can be pulled from the well and emptied as desired.

In the case wherein the particulate matter tends to float within the liquid part of the mixture, a strainer is added after the initial inertia separation of particles from the liquid. The strainer prevents the passage of particulate matter which would tend otherwise to float upward into the output port by which the liquid passes up the tube.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, THAT WHICH IS CLAIMED IS:

1. A sand separator for use in separating sand and other particulates from fluids being extracted from a well comprising:

tubing for raising liquids from a well;

a sand trapping casing coupled to said tubing;

means coupled to said sand trapping casing for extracting liquid therefrom for passage up said tubing;

said sand trapping casing including a high velocity orifice through which liquids are drawn from said well, said liquids and any sand and particulate matter carried by said liquids being accelerated in passing through said high velocity orifice;

whereby any said sand and particulate matter carried by said liquid is propelled into said sand trapping casing and said liquid passes up said tubing; and said sand trapping casing further includes means coupled therein for directing any said sand and particulate matter exiting said high speed orifice toward the bottom of said sand trapping casing, said means for directing said sand and particulate matter comprising a conic-shaped vessel open at a first end to receive said sand and particulate matter, and open at a second end to allow egress of said sand and particulate matter from said vessel.

2. The sand separator of claim 1 wherein said fluids being extracted from said well comprise both gaseous and liquid components and said sand separator further comprises;

an open topped, gas separation casing coupled to said sand trapping casing encompassing and rising above said high velocity orifice; and a well casing into which said sand separator is emplaced;

whereby liquids are drawn to overflow into said open topped gas separation casing while said fluid gasses rise up said well casing.

3. The sand separator of claim 1 wherein said fluids being extracted from said well comprise both gaseous and liquid components and said sand separator further comprises;

an open topped, gas separation casing coupled to said sand trapping casing encompassing and rising above said high velocity orifice; and a well casing into which said sand separator is emplaced;

whereby liquids are drawn to overflow into said open topped gas separation casing while said fluid gasses rise up said well casing.

4. The sand separator of claim 1 further comprising a sand strainer for restricting passage of said sand and particulate matter up said tubing, said sand strainer being coupled to said tubing to intercept liquid passing from said sand trapping casing into said tubing.

5. The sand separator of claim 4 wherein said strainer comprises a strainer body emplaced within said sand trapping casing and having a first end coupled to said tubing.

6. The sand separator of claim 5 wherein said strainer body has a selected length, there being a jet tube having an exit extending a selected distance beyond the said selected length of said strainer body, said high velocity orifice being said exit of said jet tube.

7. The sand separator of claim 5 wherein said strainer body comprises a pipe having a wall with an opening therethrough through which opening liquids flow from said sand trapping casing to said tubing said opening being covered with strainer means to permit passage of liquid to said opening while restricting passage of said sand and particulate matter.

8. The sand separator of claim 1 further comprising:

a jet-tube having an input end into which liquid enters from said well and said high velocity orifice is an output end of said jet-tube through which said liquid is ejected into said sand trapping casing;

an open topped strainer body encompassing said jet-tube, and having a base through which said output end of said jet-tube exits said strainer body;

an up-orifice in said strainer body through which liquid flows into said strainer body to flow out the open top of said strainer body; and strainer means coupled to said up-orifice to pass liquid from said sand trapping casing through said up-orifice while restricting passage of said sand and particulate matter from said sand trapping casing;

said open top of said strainer body being coupled to said tubing whereby liquid entering said strainer body from said sand trapping casing passes up said tubing.

9. The sand separator of claim 1 further comprising a sand strainer for restricting passage of said sand and particulate matter up said tubing, said sand strainer being coupled to said tubing to intercept liquid passing from said sand trapping casing into said tubing.

10. The sand separator of claim 9 wherein said strainer comprises a strainer body emplaced within said sand trapping casing and having a first end coupled to said tubing.

11. The sand separator of claim 10 wherein said strainer body has a selected length, there being a jet tube having an exit extending a selected distance beyond the said selected length of said strainer body, said high velocity orifice being said exit of said jet tube.

12. The sand separator of claim 10 wherein said strainer body comprises a pipe having a wall with an opening therethrough through which opening liquids flow from said sand trapping casing to said tubing said opening being covered with strainer means to permit passage of liquid to said opening while restricting passage of said sand and particulate matter.

13. The sand separator of claim 1 further comprising:

a jet-tube having an input end into which liquid enters from said well and said high velocity orifice is an output end of said jet-tube through which said liquid is ejected into said sand trapping casing;

an open topped strainer body encompassing said jet-tube, and having a base through which said output end of said jet-tube exits said strainer body;

an up-orifice in said strainer body through which liquid flows into said strainer body to flow out the open top of said strainer body; and strainer means coupled to said up-orifice to pass liquid from said sand trapping casing through said up-orifice while restricting passage of said sand and particulate matter from said sand trapping casing;

said open top of said strainer body being coupled to said tubing whereby liquid entering said strainer body from said sand trapping casing passes up said tubing.

14. The sand separator of claim 1 wherein said means for extracting liquid from said sand trapping casing comprises a pressure head within said well.

15. The sand separator of claim 1 wherein said means for extracting liquid from said sand trapping casing comprises a pump coupled to said tubing.

16. The sand separator of claim 1 wherein said sand trapping casing has a bottom plug upon which said sand and particulate matter accumulate for later removal from said sand trapping casing.

17. The sand separator of claim 3 wherein said sand trapping casing has a bottom plug upon which said sand and particulate matter accumulate for later removal from said sand trapping casing.

18. The sand separator of claim 10 wherein said sand trapping casing has a bottom plug upon which said sand and particulate matter accumulate for later removal from said sand trapping casing.

* * * * *